US010186241B2

(12) United States Patent
Langberg

(10) Patent No.: US 10,186,241 B2
(45) Date of Patent: Jan. 22, 2019

(54) MUSICAL INSTRUMENT SOUND GENERATING SYSTEM WITH LINEAR EXCITER

(71) Applicant: Eric Aaron Langberg, Milford, PA (US)

(72) Inventor: Eric Aaron Langberg, Milford, PA (US)

( * ) Notice: Subject to any disclaimer, the term of this patent is extended or adjusted under 35 U.S.C. 154(b) by 0 days.

(21) Appl. No.: 15/413,954

(22) Filed: Jan. 24, 2017

(65) Prior Publication Data

US 2017/0178610 A1 Jun. 22, 2017

Related U.S. Application Data

(60) Division of application No. 14/215,066, filed on Mar. 17, 2014, now Pat. No. 9,589,551, which is a continuation-in-part of application No. 13/681,319, filed on Nov. 19, 2012, now Pat. No. 9,305,533, which is a continuation of application No. 11/619,212, filed on Jan. 3, 2007, now Pat. No. 8,314,322.

(60) Provisional application No. 61/794,488, filed on Mar. 15, 2013.

(51) Int. Cl.

| | |
|---|---|
| ***G10H 3/12*** | (2006.01) |
| ***G10H 3/22*** | (2006.01) |
| ***G10F 1/20*** | (2006.01) |
| ***G10H 3/14*** | (2006.01) |
| ***G10D 3/00*** | (2006.01) |
| ***G10F 1/16*** | (2006.01) |
| ***G10H 3/24*** | (2006.01) |
| ***G10H 3/18*** | (2006.01) |
| ***G10H 3/26*** | (2006.01) |
| ***G10D 3/02*** | (2006.01) |
| ***G10F 5/00*** | (2006.01) |

(52) U.S. Cl.

CPC ..... *G10F 1/20* (2013.01); *G10D 3/00* (2013.01); *G10D 3/02* (2013.01); *G10F 1/16* (2013.01); *G10F 5/00* (2013.01); *G10H 3/14* (2013.01); *G10H 3/186* (2013.01); *G10H 3/22* (2013.01); *G10H 3/24* (2013.01); *G10H 3/26* (2013.01); *G10H 2220/211* (2013.01); *G10H 2220/525* (2013.01)

(58) Field of Classification Search

USPC ..... 84/723

See application file for complete search history.

(56) References Cited

U.S. PATENT DOCUMENTS

| | | | |
|---|---|---|---|
| 3,443,468 | A | 5/1969 | Kidwell |
| 3,612,741 | A | 10/1971 | Marshall |
| 3,725,561 | A | 4/1973 | Paul |
| 3,826,171 | A | 7/1974 | Kaar |
| 3,882,754 | A | 5/1975 | Godley et al. |
| 4,037,503 | A | 7/1977 | Jacobson et al. |
| 4,075,921 | A | 2/1978 | Heet |
| 4,880,203 | A | 11/1989 | Holcomb |

(Continued)

*Primary Examiner* — Christopher Uhlir

(57) ABSTRACT

A system for remotely generating sound from a musical instrument includes a linear exciter which may be configured as a brace for a sound board of the musical instrument. In one embodiment, the system includes an input configured to receive a signal representative of the sound of a first musical instrument, a linear exciter for converting the signal to mechanical vibrations, and a calibration system for altering the signal sent to the exciter.

14 Claims, 9 Drawing Sheets

(56) References Cited

U.S. PATENT DOCUMENTS 5,031,501 A 7/1991 Ashworth
5,083,491 A 1/1992 Fields
5,142,961 A 9/1992 Paroutaud
5,315,060 A 5/1994 Paroutaud
5,393,925 A 2/1995 Wilson
5,614,688 A 3/1997 Donnell
6,166,307 A 12/2000 Caulkins et al.
6,191,350 B1 * 2/2001 Okulov ..... G10H 1/0008 84/646
6,462,264 B1 10/2002 Elam
6,610,917 B2 8/2003 Ludwig
6,613,968 B1 9/2003 Devereaux et al.
6,700,047 B2 3/2004 Carter et al.
6,723,904 B1 4/2004 Dolan et al.
6,846,980 B2 * 1/2005 Okulov ..... G10H 1/342 84/613
7,087,828 B2 8/2006 Krieger
7,227,068 B1 6/2007 Van Doren
7,285,709 B2 10/2007 White et al.
7,285,716 B2 10/2007 Gilmore et al.
7,291,780 B2 11/2007 Hosler
7,432,428 B2 10/2008 Kunisada et al.
7,453,040 B2 11/2008 Gillette
7,514,614 B2 4/2009 McGrew
7,678,987 B2 3/2010 Lye
7,687,697 B2 3/2010 Ognibeni
7,786,374 B2 8/2010 Valli et al.
7,968,788 B2 6/2011 Shinjo et al.
8,222,503 B2 * 7/2012 Aspri ..... G10D 3/02 84/294
8,265,331 B2 9/2012 Zhou et al.
9,111,517 B2 * 8/2015 Webman ..... G10H 3/18
2002/0054728 A1 5/2002 Laor
2007/0180975 A1 8/2007 Paris et al.
2007/0180976 A1 8/2007 Demsey et al.
2010/0218665 A1 * 9/2010 Clark ..... G10D 3/02 84/731
2010/0307313 A1 * 12/2010 Zoran ..... G10D 1/085 84/192

* cited by examiner

MUSICAL INSTRUMENT SOUND GENERATING SYSTEM WITH LINEAR EXCITER

PRIORITY

This application is a divisional application of pending U.S. patent application Ser. No. 14/215,066, which claims priority to U.S. provisional application 61/794,488, filed Mar. 15, 2013 which is hereby incorporated by reference, and to U.S. patent application Ser. No. 13/681,319, filed Nov. 19, 2012 and now issued as U.S. Pat. No. 9,305,533, issued on Apr. 5, 2016 and which is hereby incorporated by reference, and which in turn claims priority to U.S. patent application Ser. No. 11/619,212, filed on Jan. 3, 2007 and now issued as U.S. Pat. No. 8,314,322 issued on Nov. 20, 2012, and which is hereby incorporated by reference.

FIELD OF THE INVENTION

The present invention relates to the field of music creation and musical instruments. More particularly the invention relates to generating sounds from a musical instrument without direct contact between a musician and the musical instrument.

BACKGROUND OF THE INVENTION

Typical musical instruments are designed to be played by a musician through direct physical contact of the musician with some part of the instrument. Attempts to create instruments that do not require direct contact of the musician have generally been approached from either a) mechanical actuators, or robotics, replacing the hands and/or feet of a musician and attempting to replicate the motions of the musician or b) electronic instruments which may be played by control signals from either a computing device or a control surface, such as a keyboard, played by a musician. In the first case, the musical instruments are commonly acoustic instruments and the robotics, which are activated by control signals or mechanical controls, act as the musician, producing sound from the instrument in the same manner as if a human musician were playing the instrument. In the second case, the sound is created electronically and must be converted to an audible sound using an amplifier and loudspeaker.

Some musical instruments are available in two forms: acoustic instruments and electric instruments. Acoustic instruments can be played and heard by an audience without the need for amplification or loudspeaker. An example would be an acoustic piano, which can be heard in a room without any form of electronic amplification. Electric instruments generally require some form of electronic amplification and loudspeaker to be heard by an audience and have an output jack which sends an electrical signal to amplifiers, processing electronics or recording devices. An example would be an electric piano or synthesizer which would require an electronic amplifier and loudspeaker to be heard. Musicians choose acoustic or electric instruments based on the desired sound and application and often will switch back and forth between them based on the song being performed to employ the different sounds.

An acoustic instrument creates an audible sound by the creation of vibrations within the instrument which are generated by the actions of the musician. The vibrations excited within the instrument by the musician are affected by the physical form of the instrument, which serves to excite corresponding vibrations in the air surrounding the instrument. The vibrations of the air around the instrument are carried as sound waves through the air to the ear of the listener. An acoustic instrument generally has a different sound characteristic than its electric counterpart, mainly due to the construction of the body of the instrument, which has a significant impact on the overall sound. Body characteristics, materials, and construction methods that make for a good acoustic instrument are generally quite different than those that make for a good electric instrument.

An electric instrument generates an analog electrical signal in response to the actions of a musician. This signal is sent to an electronic amplifier, which drives a loudspeaker to create sound waves which can travel through the air to the ear of the listener.

Many instruments are available in either acoustic or electric form and some are available in a combined form. One such combined form is the inclusion of an electric sensor or microphone in an acoustic instrument, such as an acoustic guitar, so the instrument may be used as an acoustic instrument or the electrical output may be plugged into other electronics, such as an electronic amplifier. Attempts to provide an acoustic sound from an electric instrument have been attempted by inclusion of a mechanical sensor in an electric instrument to pick up the mechanical vibrations in the instrument and convert them to an electrical output signal. The acoustic properties of the electric instrument are vastly different from those of the acoustic instrument, so these combined form instruments frequently result in a reduction in the sound quality of the electric sound, the acoustic sound, or both.

One problem encountered by musicians is the inability to easily switch back and forth between the acoustic instrument sound and the electric instrument sound in the same performance. In the case of an instrument that is held in the hands as it is played such as guitar, violin, saxophone, etc., the musician must put down or let go of one instrument, for example an acoustic guitar, before playing another, for example an electric guitar. This can interfere with a performance because the musician must stop playing for a period of time while changing instruments. The combined form of an electric and acoustic instrument mentioned earlier is an attempt to improve this situation, but as mentioned previously the body of the instrument greatly affects the sound and the combined form usually results in inferior sound from either the acoustic instrument sound or the electric instrument sound from these combined instruments.

Another problem faced by musicians is that generally only one instrument may be played at a time. If a musician had the capability of having one performance generate sound from multiple instruments, the overall sound could be much fuller and richer. Electronic synthesizers often have the capability of generating multiple sounds from a single performance, but other traditional instruments do not.

Another problem encountered with the existing state of musical instruments is that there is no way to exactly repeat a performance using a different instrument. If a musician plays and records a piece of music perfectly on an electric guitar, for example, and then later decides it would sound better on an acoustic guitar, the entire performance must be repeated and recorded using the acoustic guitar, which can take significant time due to the chance for mistakes.

Yet another shortcoming of the existing art in musical instruments is that all instruments must be available to the musician at the time of the performance. There is a standard called Musical Instrument Digital Interchange (MIDI) which provides for the recording of certain performance information which can then be used to trigger sounds from a synthesizer at a later time, but the standard does not include provisions, method or any mechanism for generating sounds from a real instrument.

What is needed is a way to enable the playing of a musical instrument without the musician having to physically touch it so the musician may "play" multiple instruments at the same, switch back and forth between different instruments without having to stop playing, use a previously recorded signal to play a musical instrument, or play an instrument in a remote location.

SUMMARY OF THE INVENTION

Disclosed is a system and method for remotely generating sound from a musical instrument. In one embodiment, the system includes an input configured to receive a signal representative of the sound of a first musical instrument, an exciter for converting the signal to mechanical vibrations, and a coupling interface for coupling the mechanical vibrations into a second musical instrument. The externally generated signal from the first musical instrument is generally an analog electrical signal carried on a wire or wires.

An object of the disclosed system is to provide a device for remotely generating sound from a musical instrument.

Yet another object of the disclosed system is to provide a device which can accept an input signal, convert the input signal into vibrations, and couple the vibrations into a musical instrument, producing a sound different from that of the original input signal.

An object of the disclosed method is to provide a method for playing a musical instrument without physically touching it. Disclosed is a method which allows generation of sound in a musical instrument from a remote signal, without requiring physical contact between a musician and the instrument.

Another object of the disclosed system is to provide a device which can be easily attached to or removed from an acoustic instrument.

Another object of the disclosed system is to provide a system which can be calibrated, taking into account the response of an acoustic instrument to which the system is mounted.

DETAILED DESCRIPTION OF THE PREFERRED EMBODIMENTS

Figure 1:
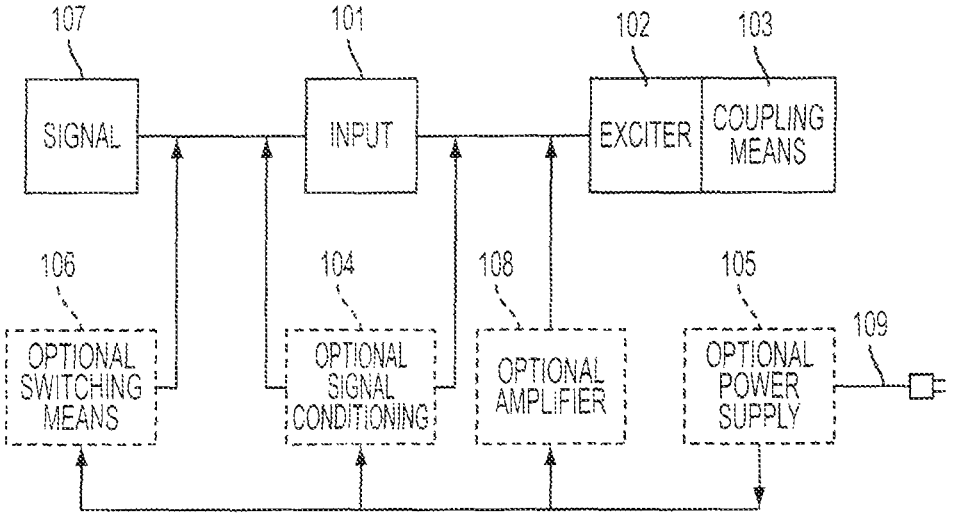
FIG. 1 is a Block Diagram of Disclosed system

The disclosed system comprises a system and method for using a signal to excite vibrations in a musical instrument without a musician having to physically touch the instrument. By exciting vibrations at the correct location(s) in the instrument, the overall sound characteristic of the instrument is maintained even though a musician is not playing the instrument in the traditional manner.

In one embodiment, the disclosed system provides an input for receiving an externally generated signal, an exciter for creating vibrations, and a coupling interface for coupling the vibrations into a musical instrument. In an embodiment, the externally generated signal is an analog electrical signal carried on a wire or wires.

The disclosed system provides a significant improvement in the amount of flexibility afforded the musician during performance by allowing the musician to get sound from a second instrument while playing a first instrument, without having to stop playing the first instrument.

Another benefit of the disclosed system is that it allows an instrument to be played which is remotely located. A signal may be transmitted using any available transmission method to another location where the disclosed system is installed and the instrument on which the disclosed system is installed may be played by the remote signal. This would allow for totally new ways of transmitting and receiving live performances. Instruments may be distributed in many different locations, including private homes, with the disclosed system installed. A musician can play a single instrument which would be used to generate the signal to be transmitted to all the distributed disclosed systems. Each instrument to which the disclosed system was installed would, upon receiving the signal, sound as if the musician were in the room playing that particular instrument.

The disclosed system may also be used to allow an instrument to be played at a different time than the original performance. A recording of a performance may be used as the signal sent to the disclosed system. The recorded signal would "play" the instrument without a musician even being present at the time of playback. This provides a way to play an instrument that is not available to the musician at the time of the original recording or the ability to go back to a recording and change the sound of an instrument by having the recorded signal play a different musical instrument than the one originally recorded.

The disclosed system allows an instrument to be played via a signal generated by another instrument or computer to get a totally different sound that combines the sound characteristic from the original instrument with the sound characteristic of the instrument to which the disclosed system is installed.

The system may be made removable by employing a removable attachment means, including mounting provisions for easily affixing the system to a structure of an acoustic instrument. The removable attachment means may attach to the body, strings, sound hole, or some other structure of the acoustic instrument. The removable attachment means may comprise a clamp, bracket, flange, brace, retaining bar, or other such structure that can be readily attached and detached. In an embodiment for a string instrument, the removable attachment means is configured to attach to a top or soundboard of the acoustic instrument proximate to a sound hole of the string instrument, while positioning the coupling interface to be in contact with a bridge or saddle of the string instrument. In an alternate embodiment, the removable attachment means is configured to secure the system to the strings of a string instrument while positioning the coupling interface to be in contact with a bridge, saddle, or contacting a string or strings directly opposite the point where the string contacts the saddle or bridge.

In an embodiment, a bracket is provided, which spans a sound hole or a portion of the sound hole of an acoustic guitar. The bracket is held in place by a groove along the edges of the bracket, forming a top and bottom lip, which slides onto the sound board at the peripheral edge of the sound hole. The exciter is secured to the bracket by at least one standoff which positions the coupling interface to contact the saddle of the guitar with pressure exerted on the saddle. The vibrations of the exciter travel through the coupling interface through the saddle and into the rest of the guitar. In a variation of this embodiment, the coupling interface contacts the strings of the acoustic guitar at or very near the saddle, imparting vibration through the strings and into the saddle.

In an embodiment for use with an acoustic guitar or bass, the removable attachment means comprises a T-shaped clamping bar having a stem and a cross bar. The stem is attached to the cross bar at one end and includes a distal end away from the cross bar. The cross bar is aligned substantially parallel to the strings and inserted between the center two strings. The cross bar is then rotated ninety degrees (90°) around the axis of the stem to be perpendicular to the strings. The distal end of the stem is pulled away from the strings, drawing the cross bar up tight against the strings, applying tension to the strings and securing the system to the strings. The stem is secured to maintain the tension on the strings. The stem may be secured at the distal end by a cam, threaded fastener, pin, fork, or other locking means. The clamping bar may be made from metal, such as aluminum, brass, steel, or other suitable metal, or may be made from other materials of sufficient strength to apply tension to the strings without breakage or deformation of the clamping bar. A variety of strong plastics or composites, including phenolics, acetals, cellulosics, and other polymers, may be used for the clamping bar. The stem and cross bar may be made from the same material or made from different materials fastened together.

In an embodiment, the system includes response adjustment using at least one transducer for signal feedback and error correction. A microphone and/or vibration transducer is used to sense the acoustic and/or vibration response of the acoustic instrument to which the system is attached and form a feedback signal. The feedback signal is compared to a target response to create an error signal, which is applied to a response corrector to formulate a corrective transfer function which corrects the input signal. The feedback, correction, and processing is implemented using digital signal processing (DSP), however analog processing or a combination of digital and analog processing may be used as well. The DSP includes various predetermined target responses to which the actual response of the acoustic instrument is compared. The DSP alters the transfer function of the response corrector to modify the output signal being applied to the exciter, providing the overall characteristic sound of the target response from the acoustic instrument.

In one embodiment, the response adjustment is self-calibrating, using a predetermined calibration signal to excite vibrations in the acoustic instrument across the audio spectrum. A microphone and/or vibration transducer is used to create a feedback signal representing the physical response of the acoustic instrument to the calibration signal. The feedback signal is then analyzed and compared to a predetermined target response, generating a physical response error signal, which is the difference between the actual response and the target response across the measured spectrum. The physical response error signal is stored in the DSP and the inverse of the physical response error signal is combined with the input signal to create a corrected physical response.

In one embodiment, the response adjustment is performed more than once, either continuously or at regular intervals. In this embodiment, the input signal is analyzed and compared to a predetermined target input signal, generating an input error signal, which is the difference between the actual input signal and the target input signal. The input signal is then modified to create a modified input signal which more closely resembles the target input signal. In an embodiment, this approach is combined with the self-calibrating approach using a physical response feedback signal. The combined approach uses the modified input signal to compensate for variations in input signal and the calibration signal, physical response feedback signal, and physical response error signal to compensate for the physical response of the acoustic instrument.

The signal processing used in the response adjustment may include the stages for audio filtering, dynamics processing, including compression and expansion, and gain adjustment, however not all stages will be necessary for all acoustic instruments. Optionally, additional processing stages may be included as well, such as variable delay processing, time alignment, phase correction, etc.

The vibration transducer used for mechanical feedback during response adjustment may be incorporated into the acoustic instrument, may be attached to the acoustic instrument separately from the exciter, or may be integrated into the exciter housing in a manner that provides contact with the body of the acoustic instrument when the exciter is properly installed on the acoustic instrument. Likewise, the microphone used for acoustic feedback during response adjustment may be incorporated into the acoustic instrument, mounted to the acoustic instrument separately from the exciter, or may be integrated into the exciter housing.

In the following description of one embodiment, reference is made to the included drawings which form a part of this specification and are included to illustrate specific embodiments of how the disclosed system may be practiced. It should be understood by the reader that structural changes may be made without departing from the scope of the disclosed system. It should also be understood that the embodiment(s) illustrated is not intended to limit the scope of the disclosed system and the inventor anticipates changes in the structure and form of the disclosed system to properly adapt to the physical form of different musical instruments.

FIG. 1 is a block diagram of an embodiment of the disclosed system and its operation. The disclosed system is a system which comprises an input 101, at least one exciter 102, and a coupling interface 103 and is designed for the purpose of creating vibrations in a musical instrument, making the instrument radiate sounds as if it were being played by a musician directly.

A signal 107 is generated, by a first musical instrument, by a recording of a first musical instrument, or by other method, which represents the sound of a first musical instrument. Signal 107 is typically an analog electrical signal produced by an electric instrument, such as an electric guitar.

The system is installed on a physical object, such as a second musical instrument.

The signal 107 is fed to the input 101 of the system, optionally passing through a switching system 106 and/or a signal conditioning element 104.

The input 101 receives the signal 107, which may be transmitted from the source in a variety of ways including, but not limited to, a wire, optically, RF waves or other wireless transmission methods. Signal transmission systems and methods are well known in the art for carrying electrical, optical, acoustic, and radio frequency signals. The input 101 may comprise a jack, a plug, a hard-wired connection, a wireless connection, or other device for receiving the signal 107. If required, the input 101 converts the received signal to an electrical signal.

The exciter 102 accepts the electrical signal from the input 101 and converts it to mechanical vibrations. Transducers to convert electrical signals to mechanical vibrations are well known in the art and many of the different types may be employed in the practice of the disclosed system including, but not limited to, solenoids, linear actuators, piezoelectric transducers, and electromagnetic actuators. An electromagnetic transducer based on a fixed permanent magnet and a moving coil of wire mounted to a former is well known in the art and may be employed as the exciter in the practice of the disclosed system. The range of human hearing is normally taken to be 20 Hertz to 20,000 Hertz but musical instruments often have a frequency range significantly less than the full range of human hearing. Optimally, the exciter 102 would be capable of exciting all frequencies of vibration that the acoustic instrument could normally reproduce. However, the exciter 102 may be effectively employed to reproduce a subset of those frequencies where the frequencies of vibration would not normally be heard, the input signal 107 is of limited bandwidth, or certain frequencies are not desired for a particular sound or special effect.

The coupling interface 103 provides a way to transfer the vibrations from the exciter 102 to the target instrument. Optimally, the coupling interface 103 would include mounting provisions for keeping the disclosed system in contact with the target instrument for effective transmission of the mechanical vibrations from the exciter 102 to the instrument. The vibrations may be coupled through direct contact of some portion of the exciter 102 to some portion of the instrument, or they may be coupled through an additional element or elements. In one embodiment, the mechanical actuator is integrated directly into the structure of the musical instrument to directly couple the vibrations into the structure of the instrument. In this embodiment, the coupling interface 103 would be the direct contact of at least some portion of the exciter 102 to some portion of the instrument structure. In other embodiments, the coupling interface 103 may take the form of a mounting bracket, adapter, clamp, adhesive, or other forms or materials which direct the vibrations formed by the exciter 102 into the instrument. The coupling interface 103, as well as mounting provisions, may be integrated into the housing of the exciter and still be within the scope of the disclosed system. The only requirement for the coupling interface 103 is that there be a manner in which the vibrations from the exciter can be transferred to the target instrument. In one embodiment, the coupling interface 103 would take the form of an adapter configured to mount the exciter in the optimum location on a target instrument, however the coupling interface 103 need not embody a separate physical component.

An optional signal conditioning element 104 may be placed anywhere in the signal path to modify the signal 107 prior to the signal getting to the exciter 102. The signal conditioning element 104 may comprise one or more active or passive electrical circuits. This may be done to emphasize or de-emphasize certain frequencies to achieve a better overall sound. It may also be done to change the amplitude of the signal 107, add special affects, or provide other signal transformations as are well known in the art of music electronics. Signal conditioning of musical instrument signals is well known in the art and includes many effects such as chorus, reverberation, time delay, phase shifting, amplitude modulation, frequency modulation, distortion, overdrive, spectral modifications, equalization and others.

The disclosed system may be practiced in such a manner that no power other than the input signal 107 is required if the input signal 107 can be ensured to be large enough to drive the exciter 102 directly. In cases where this is impractical, for example when the input signal 107 is transmitted to the input 101 via a wireless connection, a power supply 105 and signal amplifier 108 would be added to the system to generate a strong enough signal to drive the exciter. The power supply 105 may get power from an AC power cord 109 or via a battery (not shown) or other power storage device (not shown). Power supplies and amplifiers are well known in the art.

The disclosed system may be further extended in usability by inclusion of an optional switching system 106 which provides for easily directing the signal 107 from a musician's instrument to either the disclosed system input 101 or to another device's input. As an example, if the musician is playing an electric guitar and the disclosed system is mounted on an acoustic guitar, the optional switching system 106 would allow the musician to have the output from his electric guitar routed to an amplifier to reproduce the electric guitar sound, or to the disclosed system to play the acoustic guitar sound.

The system may be, but need not be, housed in a single housing. Partitioning the system into multiple assemblies can provide flexibility in application and allow for size reductions of the individual components. In some applications it may be preferable to have the exciter and coupling interface integrated into an adapter configured for easy mounting to the target instrument, with some or all of the electronics located in another housing away from the exciter and coupling interface. This would reduce the weight, size, and complexity of the exciter and coupling interface assembly. In one embodiment, the input, all electronics and a switching system would be housed in a first housing, while the exciter and coupling interface would be included in an assembly configured to mount to a target musical instrument. In an embodiment, all system components are housed together in a single structure, forming a device which may be easily installed to or removed from an acoustic instrument, although certain components, such as the coupling interface or input connector, may need to protrude through the housing.

Figure 2:
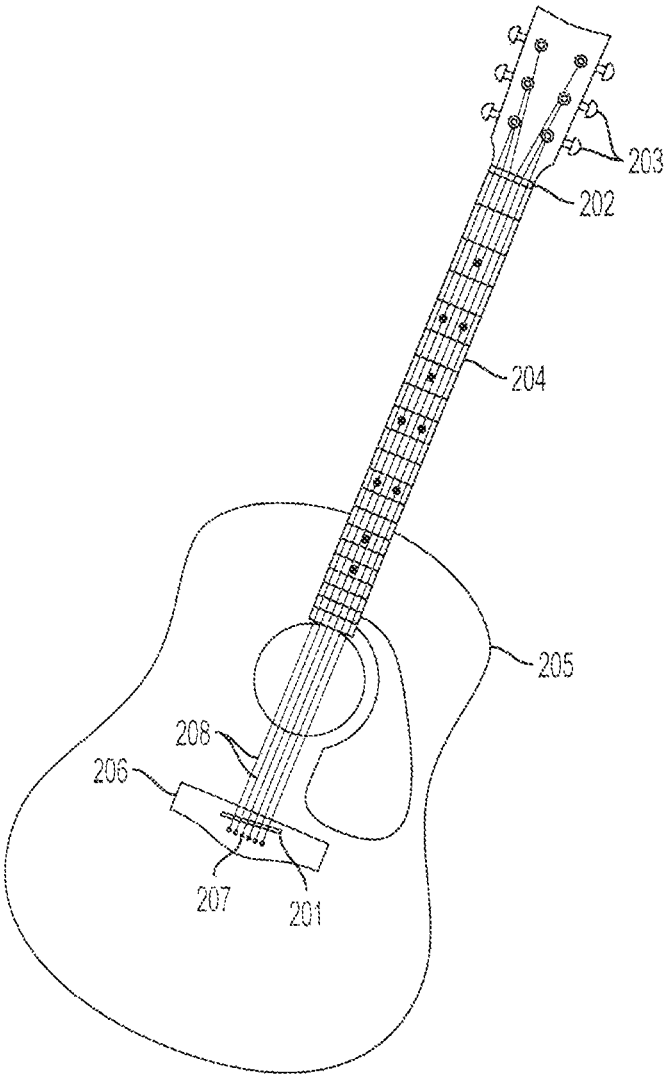
FIG. 2 depicts an Acoustic Guitar for reference.

An embodiment adapted for use on an acoustic guitar will be now described to illustrate one embodiment. A common acoustic guitar shown in FIG. 2 consists of strings 208 fixed at one end by end pins 207, routed over a support device called the "saddle" 201, which is mounted to the bridge 206, to another support device called the"nut" 202 and to tuning mechanisms 203 which allow the tension of the strings 208 to be adjusted. The strings 208 are set into motion by the actions of the musician who generally strums or picks the strings. The vibration of strings at different tensions creates the different notes heard from the guitar. The musician may change the tension and length of the vibrating string by pressing the string to the neck 204 of the guitar at different points to create different notes. The bridge 206 is attached to the top of the body 205 of the instrument and with the saddle 201 forms the main point of contact for the vibrations of the strings 208 to be coupled to the body 205 of the instrument. The sound of the guitar is primarily a result of the coupling of the vibrations of the strings 208 at the bridge 206 to the body 205 of the guitar and the resulting vibration of air in and around the body 205 of the guitar. Vibrations at the nut 202 or along the neck 204 do not couple significantly in the overall sound output. When the disclosed system is used with a guitar, the optimum point of coupling is at the saddle 201. An adapter is designed to allow the disclosed system to be positioned in such a manner that it is in contact with the saddle 201 or on the bridge 206 in the region closely surrounding the saddle 201. When a signal 107 is applied to the disclosed system, the disclosed system vibrates the saddle 201 and bridge 206, which in turn vibrates the body 205 of the guitar in a manner nearly the same as the action of the vibrating strings 208, resulting in a sound which is nearly the same as that which would be created by the vibrating strings 208. Coupling the disclosed system to other points on the guitar will create a different sound than the one created when the disclosed system is attached near or at the bridge 206, but in some cases this different sound may be found to be desirable. Additionally, since the sound of the guitar is primarily a result of vibrations coupling into the bridge 206 through the saddle 201 and since the nut 202 and neck 204 do not contribute significantly to the overall sound output, the disclosed system may be used even with no strings 208 installed. In fact, it is not even necessary to have a neck 204 installed on the acoustic guitar body 205 for the disclosed system to function properly.

Figure 3A:
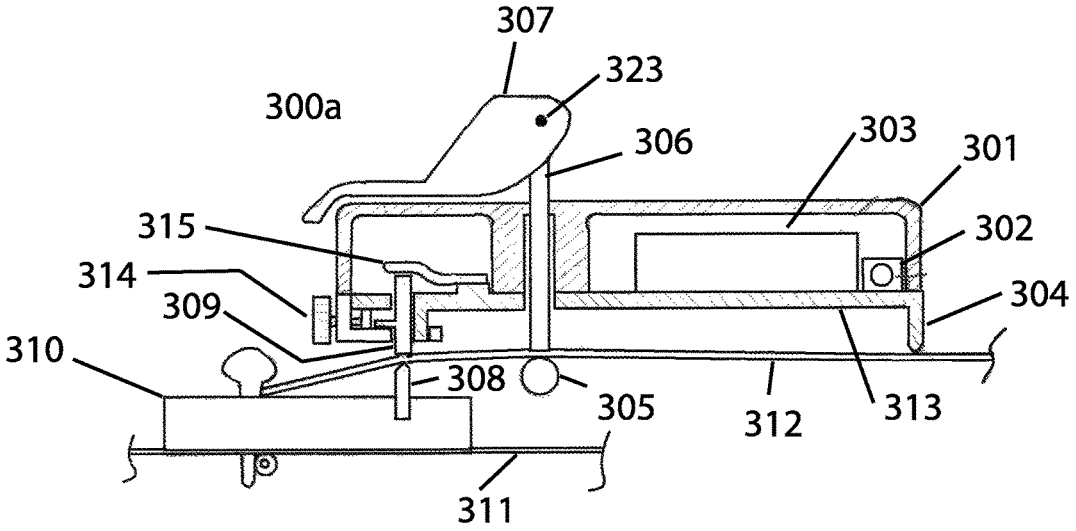
FIG. 3*a* shows a cutaway view of the system mounted to an acoustic guitar with removable attachment means in the secured position.

FIG. 3*a* shows a cutaway view of the system embodiment 300*a* mounted to the strings 312 of an acoustic guitar using a removable attachment means. The system 300*a* is positioned on the strings 312 of the acoustic guitar such that the coupling interface 309 contacts the saddle 308 of the acoustic guitar. Coupling interface 309 is urged into position by spring 315 and may be locked at a particular spacing relative to base plate 313 using screw 314. The housing assembly comprised of base plate 313 and cover 301 is clamped to the strings 312 of the acoustic guitar using a T-shaped clamping bar comprised of cross bar 305 and stem 306. The stem 306 is attached to the cross bar 305 on one end and to cam 307 by hinge pin 323 on the other end. When cam 323 is in the down position relative to cover 301, as shown in FIG. 3*a*, cross bar 305 is pulled up tight against the strings 312. This pulls the strings toward base plate 313 and forces coupling interface 309 toward saddle 308, increasing the pressure exerted by coupling interface 309 on saddle 308. Contact surface 304 provides a deflection area to maintain proper tension on the strings 312 as cross bar 305 is pulled toward base plate 313. Contact surface 304 may optionally include an elastomer (not shown) between strings 312 and base plate 313 for damping any string vibration. With the system 300*a* secured to the strings 312 and the coupling interface 309 in contact with the saddle 308, an electrical signal sent to input 302 creates mechanical vibrations in exciter 303. The mechanical vibrations are coupled through the coupling interface 309, through the saddle 308, through the bridge 310, and into the soundboard 311, producing acoustic output from the guitar.

Figure 3B:
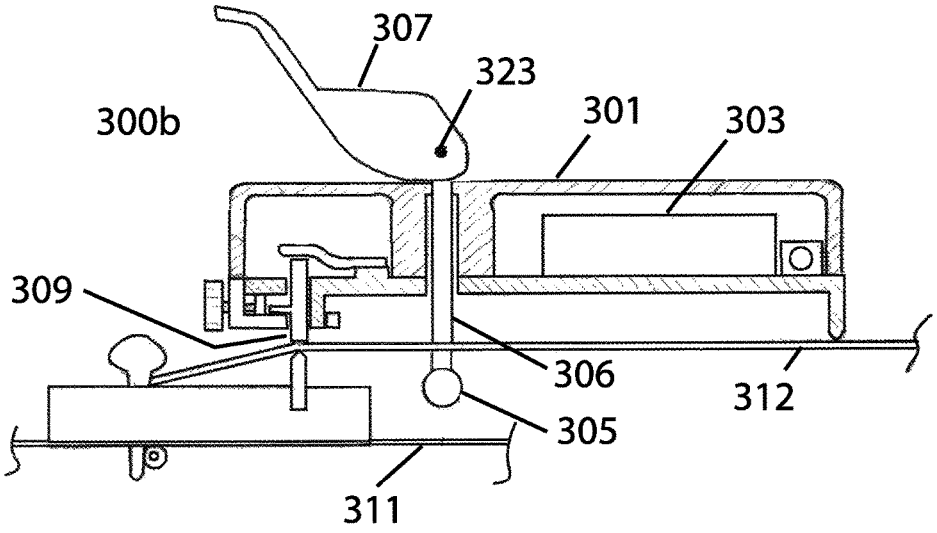
FIG. 3*b* shows a cutaway view of the system resting on an acoustic guitar in the unsecured position.

FIG. 3*b* shows the same system embodiment as FIG. 3*a*, but system 300*b* is shown with the cam 307 rotated up around hinge pin 323, moving the end of the cam away from housing cover 301. This moves stem 306 toward soundboard 311, pushing cross bar 305 away from the strings 312 and releasing the clamping tension on the strings 312 while reducing pressure from coupling interface 309 on saddle 308.

Figure 3C:
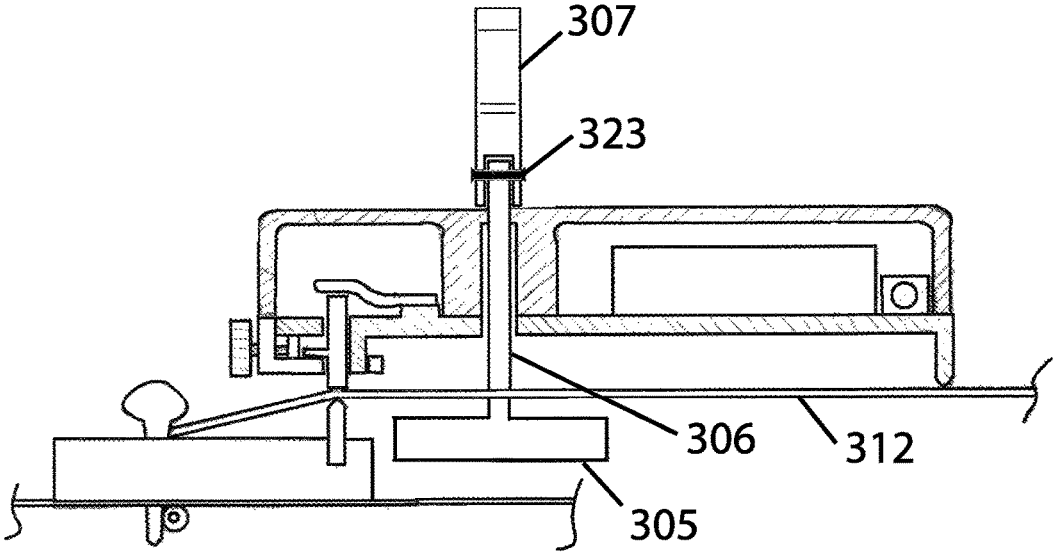
FIG. 3*c* shows a cutaway view of the system resting on an acoustic guitar in the unsecured position with the securing means rotated for removal of the system.

FIG. 3*c* shows the same embodiment as FIG. 3*b*, but cam 307 has been rotated ninety degrees (90°) around the axis of stem 306 changing the angle of cross bar 305 relative to the orientation of strings. In this orientation, cross bar 305 is positioned parallel to the strings and may be easily slid up between the strings 312 to remove the system from the acoustic guitar.

Figure 4:
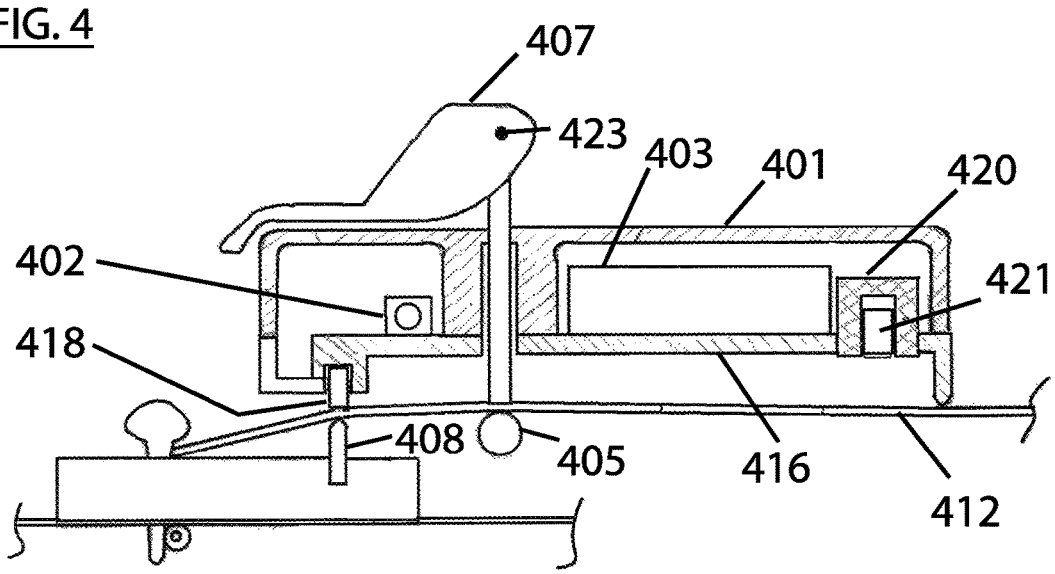
FIG. 4 shows a cutaway view of the system with included microphone.

FIG. 4 shows a cutaway side view of an embodiment mounted on the strings 412 of an acoustic guitar. The embodiment includes a microphone 421 which is housed in vibration damper 420. Vibration damper 420 is made from an elastomeric material to isolate the vibrations of base plate 416, housing 401, and coupling interface 418 from microphone 421. Microphone 421 is used to sense the acoustic output from the acoustic guitar for sending a feedback signal to the system electronics (not shown). Microphone 421 may also be used to provide a signal for amplifying or recording the sound of the acoustic guitar. Microphone 421 may be an electret style microphone, a dynamic microphone, or other acoustic sensor.

Figure 5:
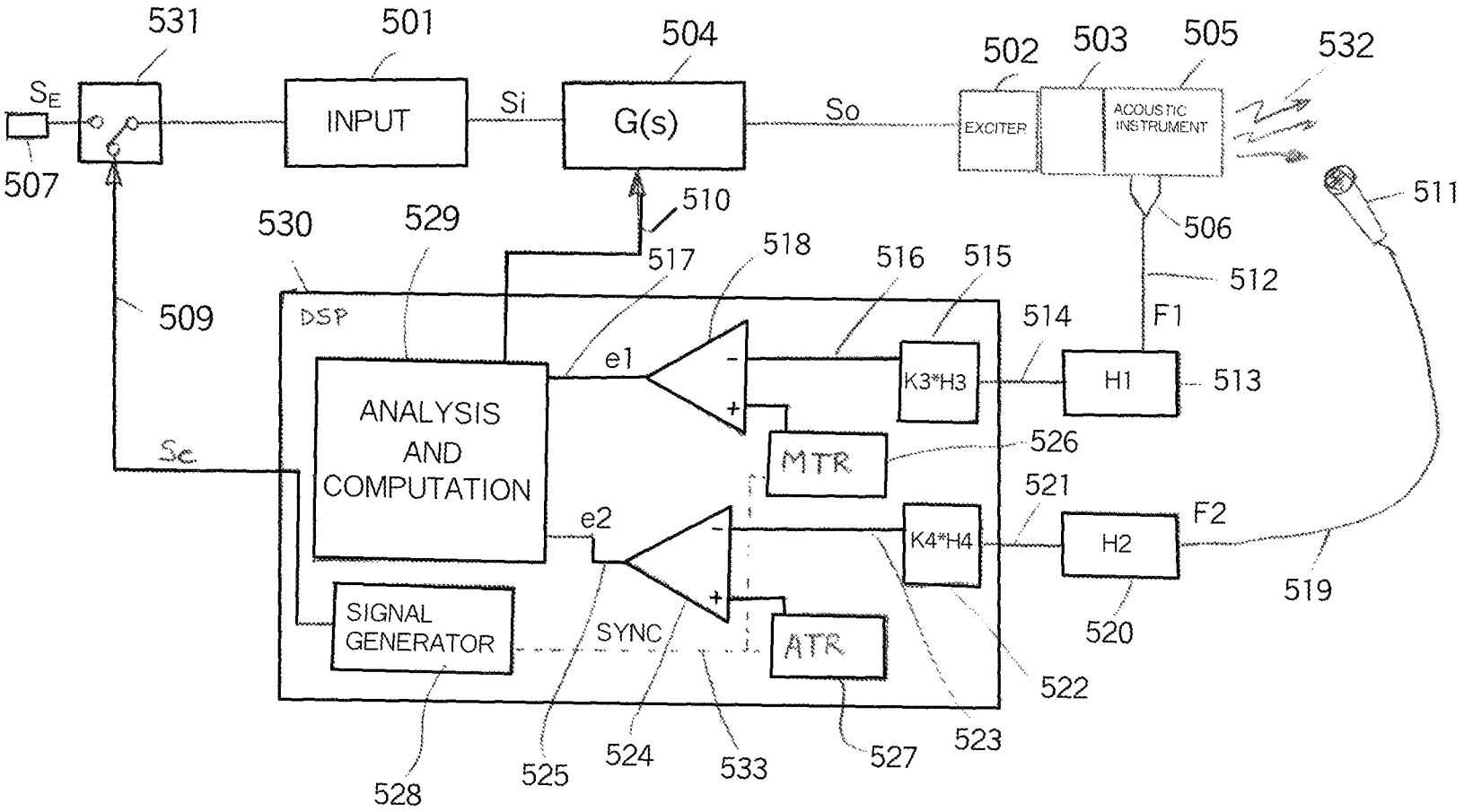
FIG. 5 shows a block diagram for an embodiment with signal processing and response correction.

FIG. 5 shows a block diagram of an embodiment of the system including response adjustment for calibration and error correction. Input switch 531 is set to a calibration position, routing calibration signal 509 ($S_c$) to input 501, sending the signal ($S_i$) to processing circuit represented by processing block 504. Processing block 504 processes signal ($S_i$) through transfer function ($G_{(s)}$), which is initially set to: $S_i=S_o$ or more specifically: $S_o=S_c$, providing a straight pass-through of the calibration signal 509 to exciter 502. Exciter 502 creates a first set of mechanical vibrations from signal $S_o$ and couples the first set of mechanical vibrations to an acoustic instrument 505 through coupling interface 503. The coupling of the first set mechanical vibrations to the acoustic instrument 505 creates a second set of mechanical vibrations in the body of the acoustic instrument 505. The second set of mechanical vibrations in the body of the acoustic instrument 505 in turn create acoustic output 532, thereby creating audible sound from the acoustic instrument 505.

The second set of mechanical vibrations in the body of the acoustic instrument 505 are sensed by vibration transducer 506, producing a first feedback signal F1, 512, which is applied to processing block 513. Processing block 513 provides signal conditioning for signal F1, 512 according to fixed transfer function H1. The conditioned signal 514 is applied to a first input of Digital Signal Processor (DSP) 530 and optionally routed to an additional processing block 515, which may provide a fixed or variable transfer function H3, creating mechanical feedback signal 516, which is sent to comparator 518. Transfer function H3 may be modified by a weighting factor K3. A mechanical target response (MTR) signal 526 is sent to comparator 518 and compared to mechanical feedback signal 516 to create mechanical error signal $e_1$, 517. Mechanical target response signal 526 is synchronized to signal generator 528 to match the system mechanical response and corresponding error signal $e_1$, 517 with calibration signal 509.

Acoustic output 532 from acoustic instrument 505 is sensed by microphone 511, producing a second feedback signal F2, 519, which is applied to processing block 520. Processing block 520 provides signal conditioning for signal F2, 519, according to fixed transfer function H2. The conditioned signal 521 is applied to a second input of DSP 530 and optionally routed to an additional processing block 522, which may provide a fixed or variable transfer function H4, creating acoustic feedback signal 523, which is sent to comparator 524. Transfer function H4 may be modified by a weighting factor K4. An acoustic target response (ATR) signal 527 is sent to comparator 524 and compared to acoustic feedback signal 523 to create acoustic error signal $e_2$, 525. Acoustic target response signal 526 is synchronized to signal generator 528 to match the system acoustic response, and corresponding error signal $e_2$, 525 with calibration signal 509.

Error signal $e_1$, 517 is analyzed by processing block 529 to determine the variation between the expected mechanical target response and the measured mechanical target response. Similarly, error signal $e_2$, 525 is analyzed by processing block 529 to determine the variation between the expected acoustic target response and the measured acoustic response. The error signals 517 and 525 may also be analyzed relative to each other to determine the how the mechanical response corresponds to the acoustic response for a given acoustic instrument 505. Weighting factors K3 and K4 may be adjusted to set the relative influence of their respective error signals on the compensation processing. Either error signal may be temporarily or permanently eliminated from affecting the compensation by setting its respective weighting factor K3 or K4 to zero. Based on the analyses and compensation processing, a corrective transfer function is computed to compensate for the errors. The simplest form of the corrective transfer function is the inverse of the sum of the error signals, such that:

$$So=Si(1/e1+e2)$$

The corrective transfer function is loaded into processing block 504, replacing the original $G_{(s)}$ with a new $G_{(s)}$ to provide corrective processing. Calibration can be considered complete, or the process may be run one or more additional times to fine tune $G_{(s)}$ for best error correction. Once the calibration process is complete, switch 531 is switched to permit an external input signal $S_E$, 507 to route through the system components 501, 504, 502 and 503 to generate acoustic output 532 from acoustic instrument 505. Transfer function G(s) is stored in memory so calibration does not need to be repeated every time the system is used.

Different target transfer functions for MTR and ATR may be stored to provide different corrected outputs, thereby providing a number of different acoustic responses. This allows the response to be set for different types of acoustic instruments or to product different acoustic responses from a single instrument.

In an embodiment, first feedback signal 512 or second feed signal 519 is eliminated, along with the respective processing and target response signals, providing a system with a single feedback loop for determining the corrective transfer function G(s) of processing block 504.

In an embodiment, input 501 is routed directly to an input of DSP 530, with the functions of switch 531 and processing block 504 incorporated into DSP 530. In an embodiment, processing block 513 and/or processing block 520 are incorporated into DSP 530.

FIG. 6 A shows an inside view of the soundboard 601 of an acoustic guitar, with an arrangement of various shapes of braces 602, 603, and 604, which are attached to the soundboard 601 to provide strength. Braces used in acoustic guitars vary widely in shape and location from guitar to guitar. Sound hole 605 is shown for reference as it is an easily visible feature of the soundboard 601 from the outside of a standard acoustic guitar.

Figure 6A:
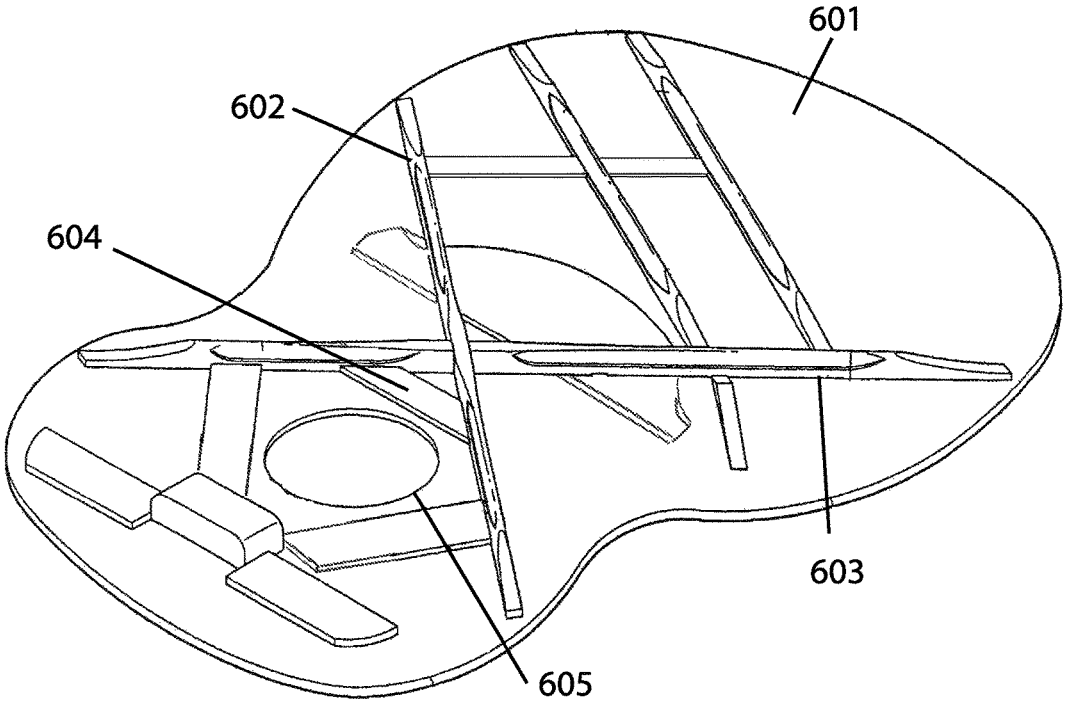
FIG. 6*a* is an inside view of the soundboard of an acoustic guitar showing an arrangement of braces.
Figure 6B:
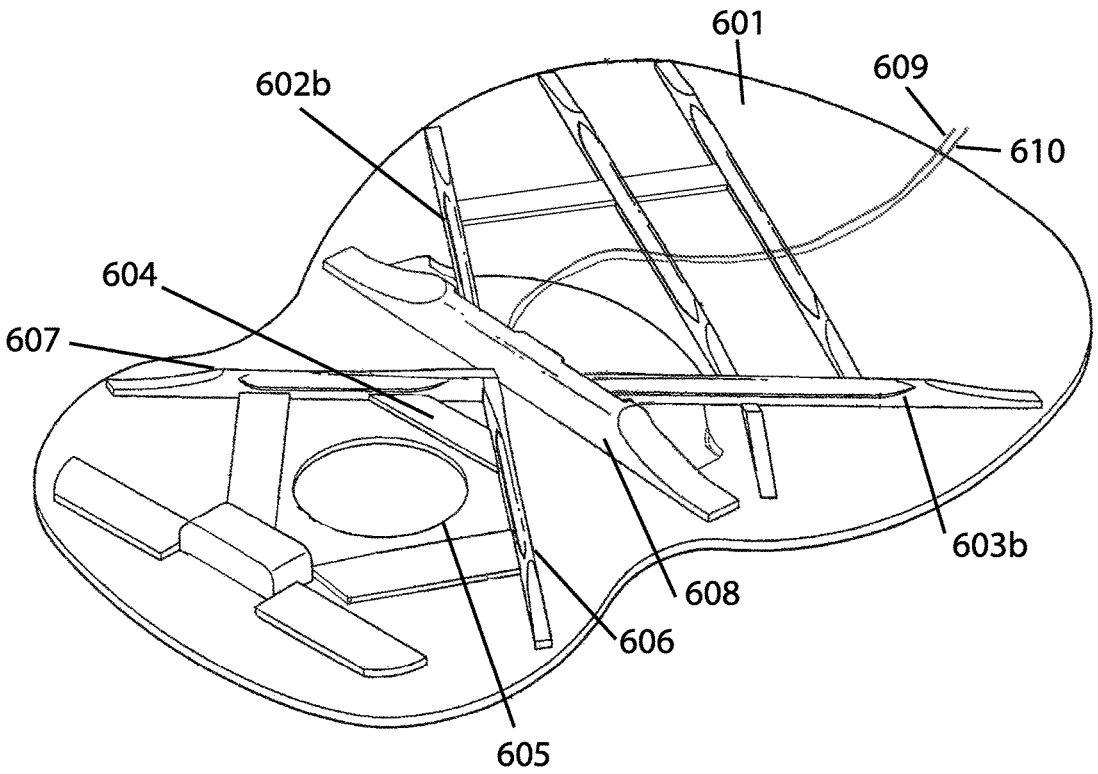
FIG. 6*b* is an inside view of the soundboard of an acoustic guitar showing an arrangement of braces with an installed linear exciter.

FIG. 6B shows an inside view of the soundboard 601 of an acoustic guitar, with an arrangement of various shapes of braces 602*b*, 603*b*, 604, 606 and 607. In this embodiment, exciter 102 from FIG. 1 is configured in a substantially linear fashion as a linear electromechanical transducer or liner exciter 608, with the length of linear exciter 608 being at least twice the width of linear exciter 608 and preferably with the length at least three times the width of linear exciter 608. Linear exciter 608 comprises an electromagnetic transducer with a permanent magnet and an elongated moving coil of wire or voice coil, but may alternatively employ a piezoelectric element, magnetostrictive system, electroactive polymers, artificial muscle, or other electro-mechanical mechanism. Linear exciter 608 is configured such that the application of an alternating electrical current to exciter 608 causes vibrations within the exciter due to the alternating magnetic fields generated in the voice coil which cause the voice coil to move relative to the permanent magnet. Sufficient mass is attached to the voice coil so that its movements create mechanical vibrations.

The linear electromechanical transducer 608 may also be configured such that the application of a voltage to the transducer causes an element of the transducer to change at least one of its physical dimensions, thereby exerting force on any object the transducer is attached to.

Linear exciter 608 is configured to be roughly the shape of an internal brace 602*b* of the guitar and is installed on soundboard 601 inside the guitar. As shown in FIG. 6*a*, main braces 602 and 603 are typically arranged in an X configuration. In the embodiment of FIG. 6*b*, the main braces are cut short at the installation area of the linear exciter 608 to form braces 602*b* and 603*b*. Additional braces 606 and 607 are added to support the rest of the soundboard 601 normally supported by main braces 602 and 602 from FIG. 6*a*. In an embodiment, linear exciter 608 is installed in an alternate location which does not require modification of the bracing system. Linear exciter 608 may also be installed as a replacement for one of the braces, for example as a replacement for brace 604, putting it closer to the sound hole 605 or for instance as a replacement for brace 609, putting it further away from the sound hole 605 and across a wider portion of sound board 601. In an embodiment the linear exciter 608 is installed inside a string instrument (not shown) directly opposite a bridge (not shown) of the string instrument, or in the case of a string instrument employing a saddle (not shown), directly opposite the saddle. Multiple linear exciters may be installed inside an instrument to form an active bracing system. Wires 609 and 610 are used to electrically connect linear exciter 608 to the system electronics (not shown). The active bracing system allows the acoustic response of the instrument to be modified based on the signals applied to the linear exciters. Linear exciters can alter the stiffness or allowable flex of the soundboard of an acoustic instrument, thereby changing its overall acoustic response and sound characteristics.

The disclosed system may be adapted to instruments other than string instruments. For example, brass instruments may be made to work with the disclosed system using a coupling element adapted to attach at the mouthpiece of the instrument. Other instruments may be adapted by considering their primary mode of sound generation and constructing a coupling interface that uses the vibrations created by the exciter to generate vibrations in the instruments in a manner similar to their primary mode of sound generation. A reed instrument, for example, creates sound when air passing over a reed causes vibrations of the reed. By considering this primary mode of sound generation, one skilled in the art would understand that a coupling interface could be constructed to impart vibrations into the reed instrument in nearly the same location that the reed would normally be located. The vibrations from the disclosed system would then couple into the instrument in a manner substantially similar to the manner in which the vibrations from the reed couple into the instrument. This approach may used to determine the proper construction of the coupling interface for other instruments.

Some applications will benefit from the use of two or more exciters and the use of two or more coupling interfaces. This may be done to extend the frequency response of the system by having multiple exciters reproduce all or a subset of the frequencies from the overall desired frequency response. Multiple exciters or multiple coupling interfaces will also be useful to more accurately direct vibrations into certain parts of a musical instrument. An example would be a string instrument with multiple saddles having an exciter and coupling interface for each saddle. It would also be useful in some instruments to use one or more exciters and/or one or more coupling interfaces at the primary region of sound generation for the instrument combined with one or more exciters and/or one or more coupling interfaces in other locations on the instrument to reinforce the vibrations in the instrument, thereby providing a louder sound or an altered frequency response from the instrument.

It is also possible to use the disclosed system to excite an instrument in a manner different from its primary mode of sound generation. This may be done to create new sounds from the instrument or to affect the spectral characteristics of the sound from an instrument. Additionally the disclosed system may even be fed an input signal generated by the instrument itself in the normal manner of playing the instrument to alter the sound or performance of the instrument. As an example, the primary mode of sound generation in a brass instrument is the vibration of the lips of the musician blowing into the mouthpiece. The disclosed system may be attached to another part of the instrument, for example the bell, to get a different sound from the instrument when presented with a signal from either an external source or from the same instrument. If the disclosed system is located at the bell of the instrument, for example, and the musician plays the instrument normally, the disclosed system would then impart different vibrations into the instrument than the normal ones. These two different sources of vibrations would combine within the instrument, creating spectral changes in the sound coming from the instrument thereby generating new sounds not available from the instrument without the use of the disclosed system. This same approach may be applied to other musical instruments.

I claim:

1. A system comprising:

an input configured to receive an externally generated signal from an electric musical instrument;

at least one exciter configured to convert the externally generated signal to mechanical vibrations, wherein at least an exciter is a linear exciter comprising an electromechanical transducer having a substantially linear shape, including a width and a length, and wherein the length is at least twice the width, and wherein the transducer is configured to be installed to an interior surface of a sound board of an acoustic guitar, such that an electrical signal applied to the electromechanical transducer causes the electromechanical transducer to exert a force on the sound board and wherein the linear exciter is configured to substitute for a brace of the sound board.

2. The system of claim 1 configured such that application of a changing voltage to the electromechanical transducer produces a changing force, thereby causing mechanical vibrations in the sound board which cause sound to be produced by the acoustic guitar.

3. The system of claim 1 wherein application of a voltage to the linear exciter causes a change in a physical dimension of an element of the transducer thereby exerting the force on the sound board.

4. The system of claim 1 comprising multiple exciters arranged to form an active bracing system for the sound board.

5. The system of claim 4 wherein the active bracing system is configured to alter an acoustic response of the sound board in response to signals applied to the exciters.

6. The system of claim 1 wherein the length is at least three times the width.

7. The system of claim 1 wherein the electromechanical transducer is configured to be install on the sound board directly opposite a bridge of the acoustic guitar.

8. The system of claim 1 further comprising the at least one exciter to include a second exciter wherein the second exciter is an electromechanical transducer having a substantially linear shape, including a width and a length, and wherein the length is at least twice the width, and wherein the second exciter is configured to be installed to an interior surface of the sound board, such that an electrical signal applied to the second exciter causes the second exciter to exert a second force on the sound board.

9. The system of claim 1 wherein application of an alternating electrical current to the exciter causes vibrations within the exciter, thereby exerting the force on the sound board.

10. The system of claim 1 wherein the linear exciter is configured to replace at least a portion of a main brace of the sound board.

11. The system of claim 2 wherein the changing force is a result of a change to at least one physical dimension of an element of the electromechanical transducer.

12. The system of claim 1 wherein the linear exciter is configured of such size and shape to serve as a replacement for a brace of the sound board.

13. The system of claim 4 wherein the active bracing system is configured to generate sound from the sound board in response to the externally generated signal.

14. The system of claim 13 wherein the active bracing system is further configured to alter an acoustic response of the sound board in response to signals applied to the exciters.

* * * * *